US007525513B2

(12) United States Patent
Yoon et al.

(10) Patent No.: US 7,525,513 B2
(45) Date of Patent: Apr. 28, 2009

(54) METHOD AND APPARATUS FOR DRIVING PLASMA DISPLAY PANEL HAVING OPERATION MODE SELECTION BASED ON MOTION DETECTED

(75) Inventors: Sang Jin Yoon, Kyoungsangbuk-do (KR); Seong Ho Kang, Daegu-kwangyeokshi (KR)

(73) Assignee: LG Electronics Inc., Seoul (KR)

( * ) Notice: Subject to any disclaimer, the term of this patent is extended or adjusted under 35 U.S.C. 154(b) by 985 days.

(21) Appl. No.: 10/743,802

(22) Filed: Dec. 24, 2003

(65) Prior Publication Data

US 2004/0135748 A1 Jul. 15, 2004

(30) Foreign Application Priority Data

Dec. 26, 2002 (KR) ..... 10-2002-0084604
Oct. 21, 2003 (KR) ..... 10-2003-0073530

(51) Int. Cl.
*G09G 3/28* (2006.01)

(52) U.S. Cl. ..... 345/60; 315/169.4

(58) Field of Classification Search ..... 345/60–72; 315/169.4

See application file for complete search history.

(56) References Cited

U.S. PATENT DOCUMENTS 6,144,364 A * 11/2000 Otobe et al. ..... 345/691
6,369,782 B2 * 4/2002 Shigeta ..... 345/63
6,646,625 B1 * 11/2003 Shigeta et al. ..... 345/63
6,653,795 B2 * 11/2003 Kang et al. ..... 315/169.3
6,724,351 B1 * 4/2004 Boger ..... 345/3.2
2002/0005857 A1 * 1/2002 Kasahara et al. ..... 345/611
2005/0128167 A1 * 6/2005 Yoon et al. ..... 345/60

FOREIGN PATENT DOCUMENTS

| | | |
|---|---|---|
| JP | 11-259043 | 9/1999 |
| JP | 2000-010522 | 1/2000 |
| JP | 2001-350448 | 12/2001 |
| KR | 2001-0091213 | 10/2001 |
| KR | 2001-0109471 | 12/2001 |

OTHER PUBLICATIONS

Korean Office Action dated Apr. 30, 2005.
Korean Office Action dated Jul. 21, 2005.

* cited by examiner

*Primary Examiner*—David L Lewis
(74) *Attorney, Agent, or Firm*—Ked & Associates LLP

(57) ABSTRACT

A plasma display panel driving method and apparatus for optimizing an AV mode and a PC mode is disclosed. In the driving method and apparatus, an operation mode is selected on a basis of a motion extent of a data. At least one of a sub-field arrangement arranged within one frame interval and the number of sustaining pulses is differently controlled in response to said selected operation mode.

22 Claims, 8 Drawing Sheets

METHOD AND APPARATUS FOR DRIVING PLASMA DISPLAY PANEL HAVING OPERATION MODE SELECTION BASED ON MOTION DETECTED

BACKGROUND OF THE INVENTION

1. Field of the Invention

This invention relates to a technique for driving a plasma display panel, and more particularly to a plasma display panel driving method and apparatus that is adaptive for optimizing an AV mode and a PC mode.

2. Description of the Related Art

Recently, there has been highlighted a flat panel display device capable of reducing a weight and a bulk in a cathode ray tube. Such a flat panel display device includes a liquid crystal display, a plasma display panel, a field emission display and an electro-luminescence display, etc. The flat panel display device applies digital signals or analog data to a display panel.

Generally, a plasma display panel (PDP) excites and radiates a phosphorus material using an ultraviolet ray generated upon discharge of an inactive mixture gas such as He+Xe or Ne+Xe, to thereby display a picture. Such a PDP is easy to be made into a thin-film and large-dimension type. Moreover, the PDP provides a very improved picture quality owing to a recent technical development.

Particularly, a three-electrode, alternating current (AC) surface-discharge type PDP has advantages of a low-voltage driving and a long life in that it can lower a voltage required for a discharge using wall charges accumulated on the surface thereof during the discharge and protect the electrodes from a sputtering caused by the discharge.

Referring to FIG. 1, a discharge cell of the three-electrode, AC surface-discharge PDP includes a scanning/sustaining electrode 30Y and a common sustaining electrode 30Z formed on an upper substrate 10, and an address electrode 20X formed on a lower substrate 18.

The scanning/sustaining electrode 30Y and the common sustaining electrode 30Z include a transparent electrode 12Y or 12Z, and a metal bus electrode 13Y or 13Z having a smaller line width than the transparent electrode 12Y or 12Z and provided at one edge of the transparent electrode, respectively. The transparent electrodes 12Y and 12Z are formed from indium-tin-oxide (ITO) on the upper substrate 10. The metal bus electrodes 13Y and 13Z are formed from a metal having a high electrical conductivity to thereby compensate for an electrical property of the transparent electrodes 12Y and 12Z having a high resistance.

On the upper substrate 10 provided with the scanning/sustaining electrode 30Y and the common sustaining electrode 30Z, an upper dielectric layer 14 and a protective film 16 are disposed. Ionized charged particles generated upon discharge are accumulated in the upper dielectric layer 14. The charged particles accumulated in the dielectric layer 14 are referred to as "wall charges". The protective film 16 protects the upper dielectric layer 14 from a sputtering of the charged particles generated during the plasma discharge and improves the emission efficiency of secondary electrons. This protective film 16 is usually made from MgO.

The address electrode 20X is formed in a direction crossing the scanning/sustaining electrode 30Y and the common sustaining electrode 30Z. A lower dielectric layer 22 and barrier ribs 24 are formed on the lower substrate 18 provided with the address electrode 20X. The lower dielectric layer 22 protects the address electrode 20X and reflects a light going toward the lower substrate 18 upon discharge, thereby enhancing light efficiency.

A phosphorous material layer 26 is formed on the surfaces of the lower dielectric layer 22 and the barrier ribs 24. The barrier ribs 24 are formed in parallel to the address electrode 20X, and divide the cells physically to shut off a leakage of an ultraviolet ray and a visible light generated by the discharge into horizontally adjacent cells to thereby prevent an optical interference between the cells as well as to shut off a movement of the charged particles generated by the discharge into horizontally adjacent cells to thereby prevent an electrical interference.

The phosphorous material layer 26 is excited and radiated by an ultraviolet ray generated upon discharge to produce any one of red, green and blue color visible lights. An inactive mixture gas, such as He+Xe, Ne+Xe or He+Ne+Xe, for a gas discharge is injected into a discharge space defined between the upper/lower substrate 10 and 18 and the barrier ribs 24.

Such a three-electrode AC surface-discharge PDP drives one frame, which is divided into various sub-fields having a different emission frequency as shown in FIG. 2, so as to realize gray levels of a picture. Each sub-field is again divided into a reset interval for uniformly causing a discharge, an address interval for selecting the discharge cell and a sustaining interval for realizing the gray levels depending on the discharge frequency. When it is intended to display a picture of 256 gray levels, a frame interval equal to 1/60 second (i.e. 16.67 msec) in each discharge cell 1 is divided into 8 sub-fields SF1 to SF8 as shown in FIG. 2. Each of the 8 sub-field SF1 to SF8 is divided into a reset interval, an address interval and a sustaining interval. The reset interval and the address interval of each sub-field are equal every sub-field, whereas the sustaining interval and the discharge frequency are increased at a ration of $2^n$ (wherein n=0, 1, 2, 3, 4, 5, 6 and 7) at each sub-field.

Such a PDP driving method is largely classified into a selective writing system and a selective erasing system depending on a scheme of selecting the cells.

The selective writing system selects cells to be turned on in the address period, hereinafter referred to as "on-cell" after initializing all the cells in the reset period. In the sustain period of the selective writing system, a sustain discharge is generated at the one cells.

In the selective writing system, a scanning pulse applied to the scanning/sustaining electrode 30Y is set to have a relatively large pulse width. For this reason, the selective writing system has a drawback in that it is difficult to sufficiently assure a sustain period because an address period becomes long.

Meanwhile, The PDP may generate a pseudo contour noise from a moving picture because of its characteristic realizing the gray levels of the picture by a combination of sub-fields. If the pseudo contour noise is generated, then a picture display quality is deteriorated. For instance, if the screen is moved to the left after the left half of the screen was displayed by a gray level value of 128 and the right half of the screen was displayed by a gray level value of 127, a peak white, that is, a white stripe emerges at a boundary portion between the gray level values 127 and 128. To the contrary, if the screen is moved to the right after the left half thereof was displayed by a gray level value of 128 and the right half thereof was displayed by a gray level value of 127, then a black level, that is, a black stripe emerges at a boundary portion between the gray level values 127 and 128.

In order to eliminate a pseudo contour noise of a moving picture, there has been suggested a scheme of dividing one sub-field to add one or two sub-fields, a scheme of re-arranging the sequence of sub-fields, a scheme of adding the sub-fields and re-arranging the sequence of sub-fields, and an error diffusion method, etc.

If the sub-fields are added so as to eliminate a pseudo contour noise of a moving picture in the selective writing system, then a sustain period becomes insufficient enough that the address period goes longer. For instance, it is assumed that the number of sub-fields in the selective writing system should be increased to 10 and a pulse width of a scanning pulse should be 3 μs in the PDP having a resolution of VGA (video graphics array) class (i.e., 640×480), then the sustain period becomes absolutely insufficient as described below. The address period occupied in one frame interval of 16.67 ms is 3 μs (a pulse width of the scanning pulse)×480 lines×10 (the number of sub-fields)=14.4 ms. On the other hand, the sustain period occupied in one frame interval becomes −0.03 ms, which is a value obtained by subtracting an address period of 14.4 ms, once reset interval of 0.3 ms, an erasure interval of 100 μs×10 sub-fields and an extra time of the vertical synchronizing signal Vsync of 1 ms from one frame interval of 16.67 ms.

In order to overcome such a lack of driving time, there has been suggested a scheme of physically dividing the PDP to drive each screen block simultaneously. However, such a scheme raises another problem in that, because driving integrated circuits must be more added, a manufacturing cost rises.

The selective erasing system selects cells to be turned off, hereinafter referred to as "off-cell", in the address period after initializing all the cells in the reset period. A sustain discharge is generated within the off-cells in the sustain period of the selective erasing system.

A scanning pulse required in the selective erasing system may be set to has a smaller number than that in the selective writing system. Thus, since the selective erasing system has an address period reduced in comparison with the selective writing system, it can assure a relatively wide sustain period. For instance, if it is assumed that one frame interval is time-divided into 8 sub-fields and a pulse width of the scanning pulse is 1 μs, then an address period occupied in one frame interval has a relatively small value of 3.84 ms, which is 1 μs (a pulse width of the scanning pulse)×480 lines×8 (the number of sub-fields). On the other hand, the sustain period occupied in one frame interval becomes approximately 11.03 ms, which is a value obtained by subtracting an address period of 3.84 ms, an extra time of the vertical synchronizing signal Vsync of 1 ms and 100 μs (reset period)×8 (the number of sub-fields), that is, a full writing interval from one frame interval of 16.67 ms. Such a selective erasing system has an advantage in that it is easy to assure a sustain period even though the number of sub-fields is increased because an address period becomes small.

However, the selective erasing system has a drawback in that, because all the cells are turned off in the reset period, a black brightness in a contrast ratio is raised to deteriorate a contrast characteristic.

In order to overcome a lack of driving time raised in the selective writing system and a deterioration of contrast characteristic raised in the selective erasing system, there has been suggested a strategy (hereinafter referred to as "SWSE scheme") of making a time division of one frame interval into sub-fields in the selective writing system (hereinafter referred to as "SW sub-fields) and sub-fields in the selective erasing system (hereinafter referred to as "SE sub-fields" in the U.S. Laid-open Patent Gazette No. US-2002-0033675-A1 filed by the applicant.

Referring to FIG. 3, the SWSE scheme makes a time division of one frame interval into 6 SW sub-fields (SF1 to SF6) selecting the on-cells in the selective writing system and 6 SE sub-fields (SF7 to SF12) selecting the off-cells in the selective erasing system.

The SW sub-fields (SF1 to SF6) can express 64 gray levels by the binary coding. The SE sub-fields (SF7 to SF12) can 7 gray levels by the linear coding. Total gray levels to be expressed by a combination of the SW sub-fields (SF1 to SF6) and the SE sub-fields (SF7 to SF12) are 64×7=448.

In the mean time, there has been actively studied a strategy permitting to operate both the AV mode and the PC mode so that the PDP can be compatibly used in a TV, a monitor of computer, a bulletin board and a signboard, etc. Herein, the AV mode is an operation mode corresponding to a TV in which a moving picture is mainly display, whereas the PC mode is an operation mode corresponding to a monitor in which a still picture is mainly display.

Optimum conditions of an image display required for the AV mode and the PC mode are different from each other. The AV mode has an ability to reduce a pseudo contour noise liable to emerge in a moving picture, whereas the PC mode has an ability to express an image by a large number of gray levels.

SUMMARY OF THE INVENTION

Accordingly, it is an object of the present invention to provide a PDP driving method and apparatus that is adaptive for optimizing both an AV mode and a PC mode.

In order to achieve these and other objects of the invention, a method of driving a plasma display panel according to one aspect of the present invention includes the steps of selecting an operation mode on a basis of a motion extent of a data; and controlling at least one of a sub-field arrangement arranged within one frame interval and the number of sustaining pulses differently in response to said selected operation mode.

The driving method further includes the step of receiving at least one of a signal from a remote controller for remotely controlling the plasma display panel, a cable signal connected to a different media and a signal from a mode selection switch provided separately at the plasma display panel.

Said step of selecting the operation mode includes determining said operation mode in response to said received signal.

Said step of selecting the operation mode includes comparing said data between frames to calculate a variation amount and then comparing said variation amount with a desired reference value, thereby selecting said operation mode.

Herein, said sub-field arrangement includes at least one selective writing sub-field for selecting on-cells in an address period; and at least one selective erasing sub-field for selecting off-cells in the address period.

Said step of differently controlling at least one of said sub-field arrangement and the number of sustaining pulses includes, if said operation mode is an AV mode in which a motion extent of said data is large, then allowing the number of selective erasing sub-fields to be larger than the number of selective writing sub-fields.

Said step of differently controlling at least one of said sub-field arrangement and the number of sustaining pulses includes, if said operation mode is a PC mode in which a motion extent of said data is small, then allowing the number of selective writing sub-fields to be larger than the number of selective erasing sub-fields.

Said step of differently controlling at least one of said sub-field arrangement and the number of sustaining pulses includes, if said operation mode is an AV mode in which a motion extent of said data is large, then selecting a first sub-field arrangement in which sub-fields are arranged to have a small contour noise at a moving picture; and, if said operation mode is a PC mode in which a motion extent of said data is small, then selecting a second sub-field arrangement in which sub-fields are arranged to have a wider gray level expression range than the first sub-field arrangement.

Said step of differently controlling at least one of said sub-field arrangement and the number of sustaining pulses includes, if said operation mode is a PC mode in which a motion extent of said data is small, then controlling the number of sustaining pulses to be smaller than the number of sustaining pulses set in correspondence with an AV mode in which a motion extent of said data is large.

Said step of differently controlling at least one of said sub-field arrangement and the number of sustaining pulses includes, if said operation mode is a PC mode in which a motion extent of said data is small, then reducing the number of sustaining pulses such that said data can be displayed at an average brightness falling in 50% through 80% with respect to an average brightness of said data displayed on the plasma display panel in an AV mode in which a motion extent of said data is large.

A driving apparatus for a plasma display panel according to another aspect of the present invention includes a mode selector for selecting an operation mode on a basis of a motion extent of a data; and a controller for controlling at least one of a sub-field arrangement arranged within one frame interval and the number of sustaining pulses differently in response to said selected operation mode.

In the driving apparatus, said mode selector receives at least one of a signal from a remote controller for remotely controlling the plasma display panel, a cable signal connected to a different media and a signal from a mode selection switch provided separately at the plasma display panel, and determines said operation mode in response to said received signal.

Said mode selector compares said data between frames to calculate a variation amount and then compares said variation amount with a desired reference value, thereby selecting said operation mode.

Said controller arranges at least one selective writing sub-field for selecting on-cells in an address period and at least one selective erasing sub-field for selecting off-cells in the address period within said one frame interval; and, if said operation mode selected by the mode selector is an AV mode in which a motion extent of said data is large, allows the number of selective erasing sub-fields to be larger than the number of selective writing sub-fields.

Said controller arranges at least one selective writing sub-field for selecting on-cells in an address period and at least one selective erasing sub-field for selecting off-cells in the address period within said one frame interval; and, if said operation mode selected by the mode selector is an PC mode in which a motion extent of said data is small, allows the number of selective writing sub-fields to be larger than the number of selective erasing sub-fields.

Herein, if said operation mode selected by the mode selector is an AV mode in which a motion extent of said data is large, then said controller maps said data onto a first sub-field arrangement in which sub-fields are arranged to have a small contour noise at a moving picture; whereas, if said operation mode selected by the mode selector is an PC mode in which a motion extent of said data is small, then said controller maps said data onto a second sub-field arrangement in which sub-fields are arranged to have a wider gray level expression range than the first sub-field arrangement.

If said operation mode selected by the mode selector is an PC mode in which a motion extent of said data is small, then said controller controls the number of sustaining pulses to be smaller than the number of sustaining pulses set in correspondence with an AV mode in which a motion extent of said data is large.

Herein, if said operation mode selected by the mode selector is an PC mode in which a motion extent of said data is small, then said controller reduces the number of sustaining pulses such that said data can be displayed at an average brightness falling in 50% through 80% with respect to an average brightness of said data displayed on the plasma display panel in an AV mode in which a motion extent of said data is large.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
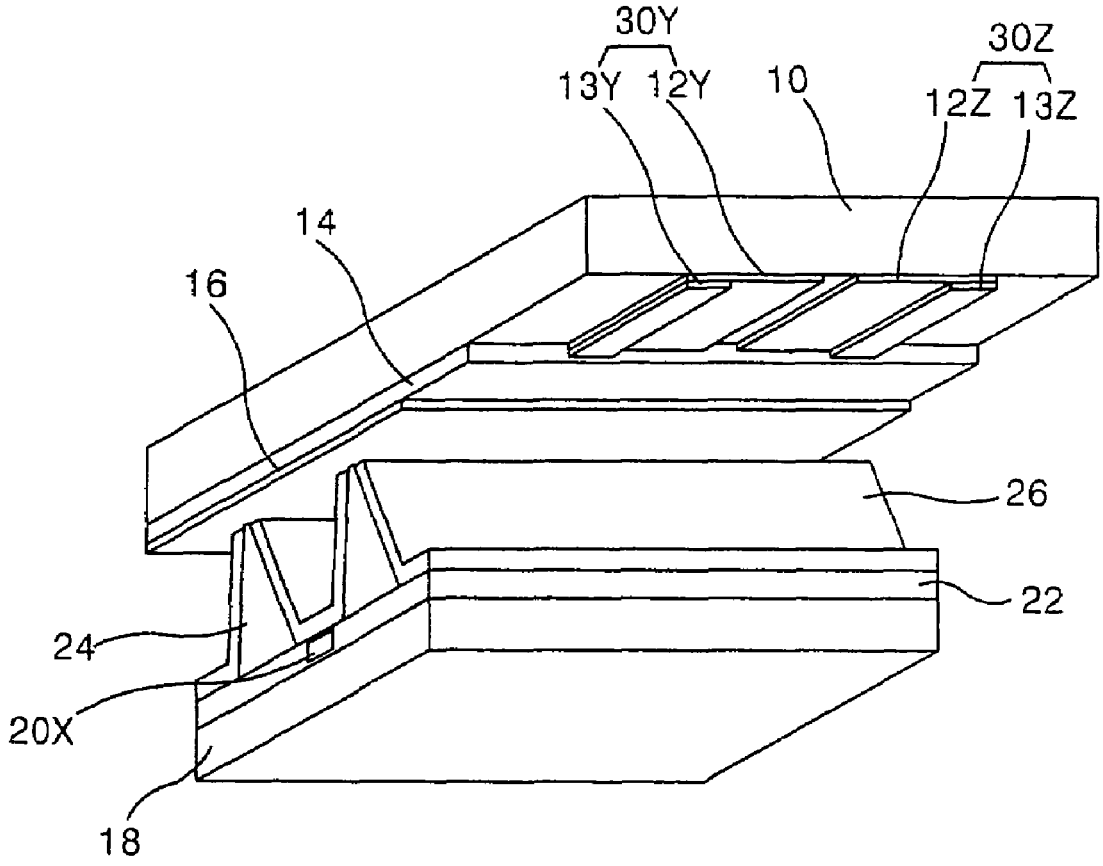
FIG. 1 RELATED ART
FIG. 1 is a perspective view showing a discharge cell structure of a conventional three-electrode AC surface-discharge plasma display panel.
Figure 2:
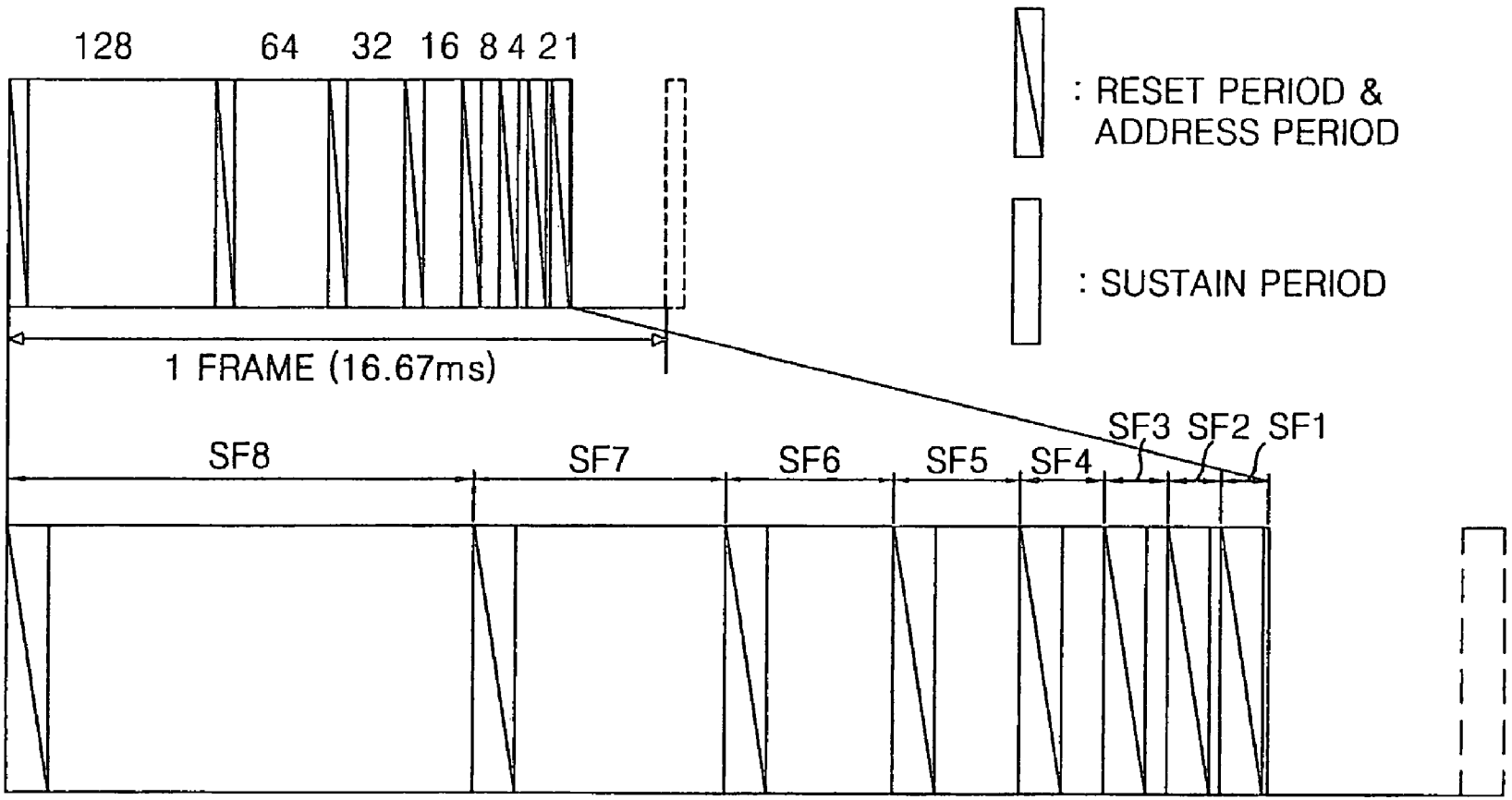
FIG. 2 RELATED ART
FIG. 2 illustrates an example of sub-field arrangement in which one frame interval is time-divided into 8 sub-fields.
Figure 3:
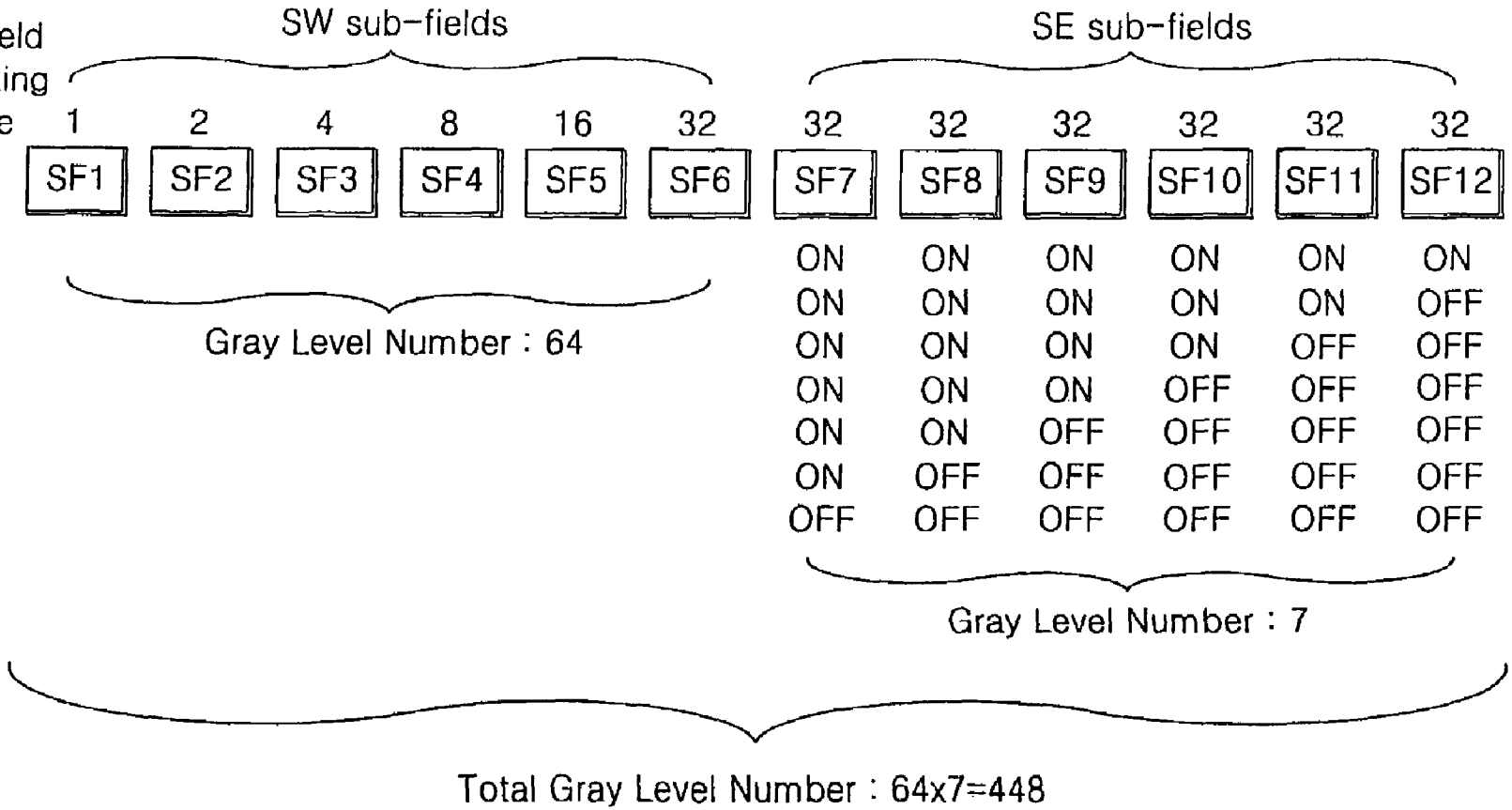
FIG. 3 RELATED ART
FIG. 3 illustrates an example of sub-field arrangement in the SWSE scheme.
Figure 4:
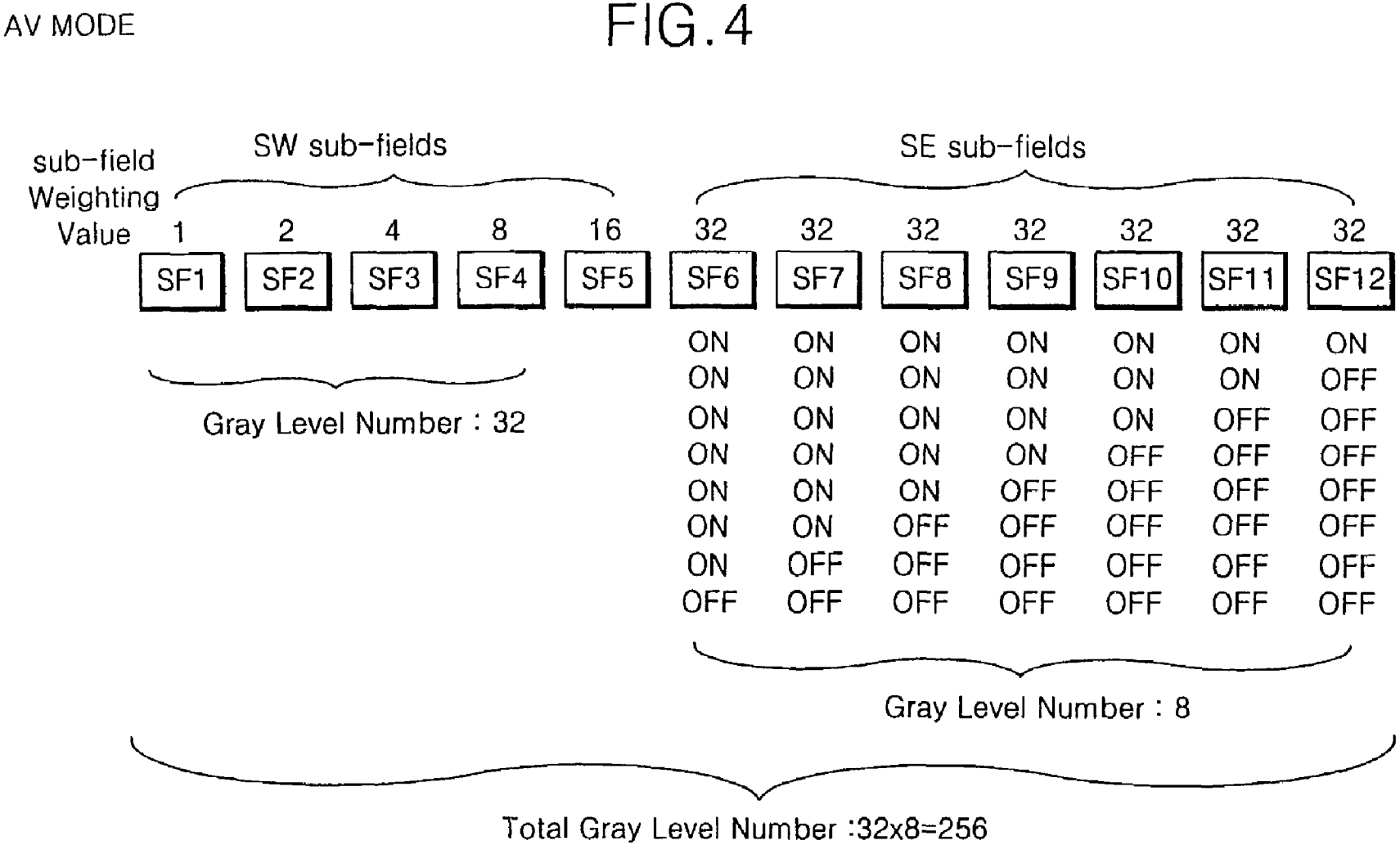
FIG. 4 illustrates an example of sub-field arrangement in the AV mode in a method of driving a plasma display panel according to an embodiment of the present invention.
Figure 5:
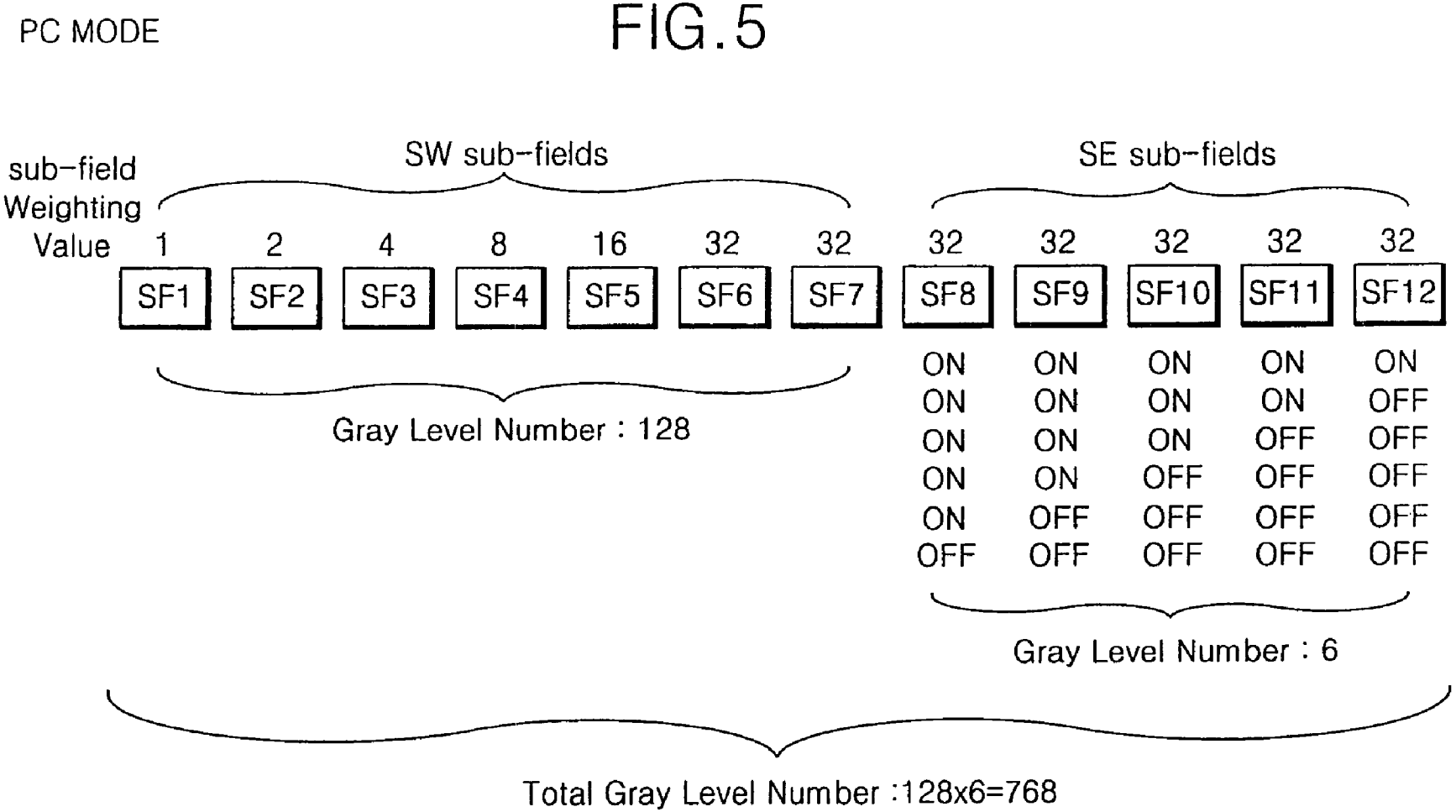
FIG. 5 illustrates an example of sub-field arrangement in the PC mode in a method of driving a plasma display panel according to an embodiment of the present invention.

FIG. 4 and FIG. 5 show a method of driving a plasma display panel (PDP) according to an embodiment of the present invention.

In the PDP driving method, SE sub-fields SF6 to SF12 having a larger number than SW sub-fields SF1 to SF5 are arranged within one frame interval in the AV mode as shown in FIG. 4, whereas the number of the SW sub-fields SF1 to SF7 is increased within one frame interval in the PC mode as shown in FIG. 5.

In the AV mode as shown in FIG. 4, the SW sub-fields SF1 to SF5 can express 32 gray levels by the binary coding, and the SE sub-fields SF6 to SF12 can express 8 gray levels by the linear coding. Thus, total 256 gray levels can be expressed by a combination of the SW sub-fields SF1 to SF5 and the SE sub-fields SF6 to SF12 in the AV mode.

In the PC mode as shown in FIG. 5, the SW sub-fields SF1 to SF7 can express 128 gray levels by the binary coding, and the SE sub-fields SF8 to SF12 can express 6 gray levels by the linear coding. Thus, total 768 gray levels can be expressed by a combination of the SW sub-fields SF1 to SF7 and the SE sub-fields SF8 to SF12 in the PC mode.

Accordingly, in the method of driving the PDP according to the present invention, the number of the SW sub-fields is increased in the PC mode to enlarge an gray level expression range, thereby expressing a still image more finely.

Each of the SW sub-fields SF1 to SF5 or SF1 to SF7 includes an address period for selecting on-cells, and a sustain period for allowing only the on-cells to cause a sustain discharge by a discharge frequency corresponding to a predetermined weighting value. Further, each of the SW sub-fields SF1 to SF5 or SF1 to SF7 may include a reset period for initializing all the cells in accordance with the sub-field, and an erasure period for erasing electric charges left within the cells after termination of the sustain discharge. The last sub-field SF5 or SF7 of the SW sub-fields has no erasure period so that off-cells can be selected from the following first SE sub-field SF6 or SF8. In the SW sub-fields SF1 to SF5 or SF1 to SF7, the reset period, the address period and the erasure period are identical to each other at each sub-field, whereas the sustain period and the sustain discharge frequency are differentiated for each sub-field in accordance with weighting values given to the sub-fields "$2^0(1)$, $2^1(2)$, $2^2(4)$, $2^3(8)$, $2^4(16)$" or "$2^0(1)$, $2^1(2)$, $2^2(4)$, $2^3(8)$, $2^4(16)$, $2^5(32)$, $2^5(32)$".

The SE sub-fields SF6 to SF12 or SF8 to SF12 includes an address period for selecting off-cells, and a sustain period for allowing only off-cells having not been selected in the address period to cause a sustain discharge by a discharge frequency corresponding to a predetermined weighting value. The sub-fields SF6 to SF11 or SF8 to SF11 other than the last sub-field of the SE sub-fields have no reset period and no erasure period. The last SE sub-field SF12 has no reset period, but has an erasure period for erasing the residual electric charges within the cells, following the sustain period, so that a stable initialization of the first sub-field SF1 can be made. Weighting values given to the SE sub-fields SF6 to SF12 or SF8 to SF12 have the same value '32'. Thus, the address periods and the sustain periods in the SE sub-fields SF6 to SF12 or SF8 to SF12 are equal to each other. Weighting values in the SE sub-fields SF6 to SF12 or SF8 to SF12 also may be given differently like the SW sub-fields SF1 to SF5 or SF1 to SF7. In this case, the sustain periods of the SE sub-fields SF6 to SF12 or SF8 to SF12 may be differentiated depending upon their weighting values.

Since the SW sub-fields SF1 to SF5 or SF1 to SF7 select on-cells by the binary coding, they optionally select on-cells irrespectively of a cell selection at each sub-field.

On the other hand, since the SE sub-fields SF6 to SF12 select off-cells by the linear coding in which off-cells are selected from on-cells selected or unselected from the previous sub-field, on-cells must necessarily exist at the previous sub-field. For instance, the first SE sub-field SF6 or SF8 selects off-cells from on-cells having been selected from the last SW sub-field SF5 or SF7. Further, the second to last SE sub-fields SF7 to SF12 or SF9 to SF12 select off-cells from on-cells having not been selected from the previous sub-fields SF6 to SF11 or SF8 to SF11. In other words, the SE sub-fields SF6 to SF12 or SF8 to SF12 take out on-cells whenever the sub-field is gone over. Thus, a contour noise caused by a discontinuous change in a light amount of the cell at a moving picture does almost not emerge at the SE sub-fields SF6 to SF12 or SF8 to SF12.

Accordingly, the method of driving the plasma display panel according to the present invention can increase the number of the SE sub-fields in the AV mode, thereby reducing a contour noise when a moving picture is expressed.

An example of a gray level expression in the AV mode and the PC mode will be described below.

A cell expressed as a gray level value '13' in the AV mode as shown in FIG. 4 and in the PC mode as shown in FIG. 5 is turned on at the first, third and fourth sub-fields SF1, SF3 and SF4 by a binary code combination while being turned off at the remaining sub-fields SF2 and SF5 to SF12. On the other hand, a cell expressed as a gray level value '75' is turned on at the first, second and fourth sub-fields SF1, SF2 and SF4 by a binary code combination and is turned on at the sixth and seventh sub-fields SF6 and SF7 by a linear code combination while being turned off at the remaining sub-fields SF3, SF5 and SF8 to SF12.

In a plasma display panel having a resolution of VGA class (i.e., 640×480), an address period and a sustain period can be calculated, assuming that a scanning pulse of the SW sub-fields should be 3 μs and a scanning pulse of the SE sub-fields should be 1 μs, as follows.

If the plasma display panel is driven in the AV mode as shown in FIG. 4, then the address period occupied in one frame interval is {3 μs (scanning pulse of SW sub-fields)×480 (the number of lines)×5 (the number of SW sub-fields)}+{1 μs (scanning pulse of SE sub-fields)×480 (the number of lines)×7 (the number of SE sub-fields)}=10.56 ms. In this case, the sustain period is 16.17 ms (one frame interval)−10.56 ms (address period)−1 ms (extra time of vertical synchronizing signal)−400 μs (erasure period of SF1 to SF4)=4.71 ms.

On the other hand, if the plasma display panel is driven in the PC mode as shown in FIG. 5, then the address period occupied in one frame interval is {3 μs (scanning pulse of SW sub-fields)×480 (the number of lines)×7 (the number of SW sub-fields)}+{1 μs (scanning pulse of SE sub-fields)×480 (the number of lines)×7 (the number of SE sub-fields)}=11.8 ms. In this case, the sustain period is 16.17 ms (one frame interval)−11.8 ms (address period)−1 ms (extra time of vertical synchronizing signal)−600 μs (erasure period of SF1 to SF6)= 3.27 ms.

Figure 6:
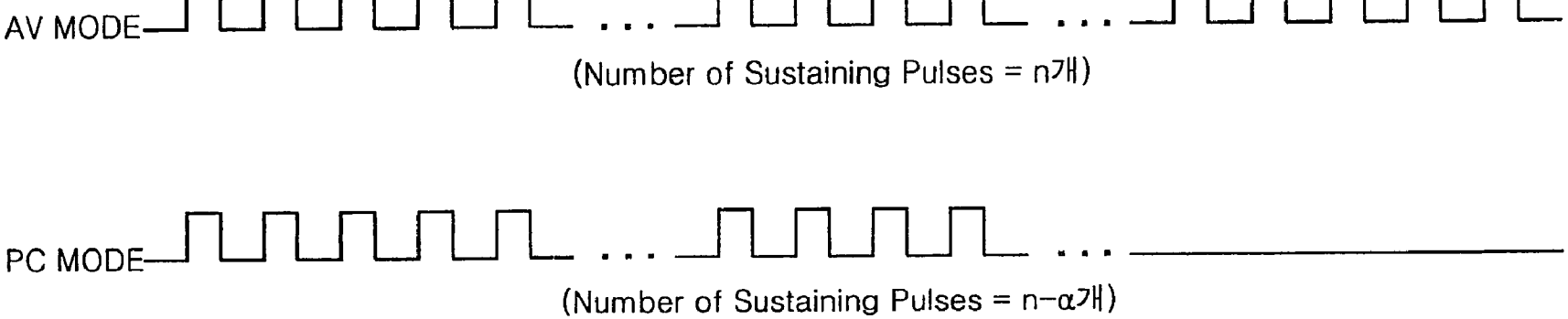
FIG. 6 is a waveform diagram of a sustaining pulse assigned to each of the AV mode and the PC mode in a method of driving a plasma display panel according to an embodiment of the present invention.

FIG. 6 is a view for explaining a method of driving a plasma display panel according to another embodiment of the present invention, which represents the number of sustaining pulses in the AV mode and the PC mode.

Referring to FIG. 6, the plasma display panel more reduces the number of sustaining pulses (n-a) assigned to the PC mode in comparison with the number of sustaining pulses (n) assigned to the AV mode. In this embodiment, one frame interval may be time-divided into only SW sub-fields or only SE sub-fields, or into SW and SE sub-fields. Preferably, a sub-field arrangement in the SWSE scheme selected in consideration of a display quality in a moving picture and a driving time.

If total number of sustaining pulses of all the sub-fields arranged within one frame interval in the AV mode is n, then total number of sustaining pulses of all the sub-fields arranged within one frame interval in the PC mode is n-a, which is reduced by a in comparison with the AV mode. Since such a sustaining pulse difference is equal to a sustain discharge frequency difference, an average brightness difference of the plasma display panel appears between the AV mode and the PC mode when the same one frame image is displayed.

The reduction value 'a' in the number of sustaining pulses assigned to the PC mode is determined such that an average brightness in the PC mode falls at 50% through 80% when it is assumed that that an average brightness in the AV mode should be 100%, so as not to have a bad effect to a picture quality.

Figure 7:
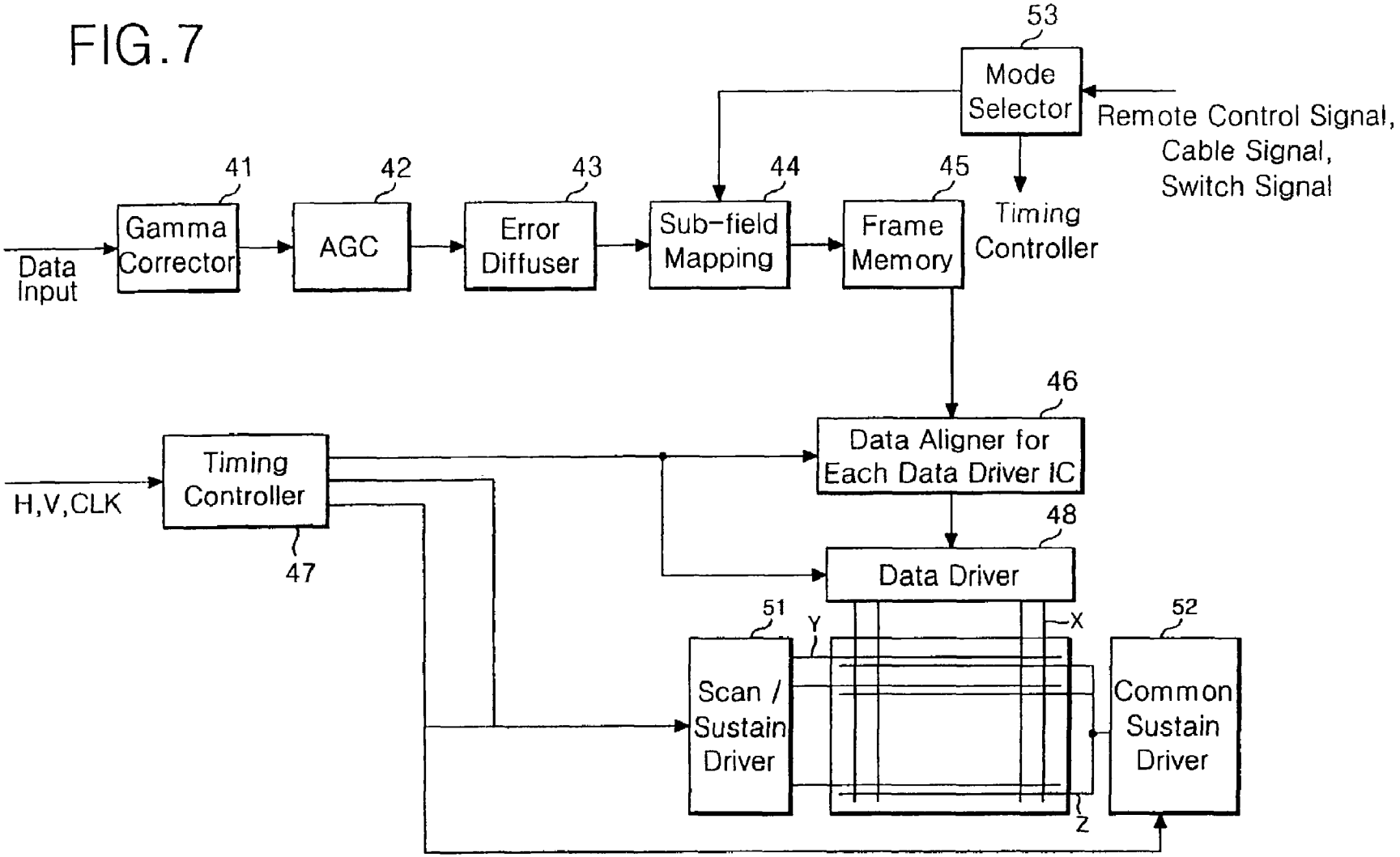
FIG. 7 is a block diagram showing a configuration of a driving apparatus for a plasma display panel according to a first embodiment of the present invention.

FIG. 7 shows a driving apparatus for a plasma display panel according to a first embodiment of the present invention.

Referring to FIG. 7, the driving apparatus for a plasma display panel includes a data driver 46, a scan/sustain driver 51 and a common sustain driver 52 connected to electrodes X, Y and Z of the plasma display panel, an automatic gain controller 42, an error diffuser 43, a sub-field mapping unit 44 and a frame memory 45 that are connected between a gamma corrector 41 and the data driver 48, a timing controller 47 for controlling an operation timing of each driving circuit, and a mode selector 53 connected to the sub-field mapping unit 44.

The data driver 48 includes a plurality of integrated circuits for supplying a data to a plurality of address electrodes X in the address period. The scan/sustain driver 51 generates an initialization waveform for initializing all the cells in the initialization period, and sequentially generates scanning pulses of SW sub-fields or scanning pulses of SE sub-fields in the address period. Further, the scan/sustain driver 51 generates sustaining pulses in the sustain period. The scan driver 51 includes a plurality of integrated circuits. Signals from the scan/sustain driver 51 are applied to a plurality of scan/sustain electrodes Y of the plasma display panel.

The common sustain driver 52 is connected to common sustain electrodes Z to simultaneously apply the sustaining pulses to a plurality of sustain electrodes Z in the sustain period.

The timing controller 47 receives vertical/horizontal synchronizing signals H and V and a clock signal CLK to thereby timing control signals required for the drivers 46, 48, 51 and 52. Further, the timing controller 47 controls the number of sustaining pulses differently in response to a signal from the mode selector 53. In other words, the timing controller 47 controls the scan/sustain driver 51 and the common sustain driver 52 by the number of sustaining pulses set to be smaller than the number of sustaining pulses in the AV mode when a current operation mode is sensed to be the PC mode by means of the mode selector 53. Thus, the scan/sustain driver 51 and the common sustain driver 52 generates a different number of sustaining pulse in the AC mode and the PC mode under control of the timing controller 47.

The gamma corrector 41 makes a gamma correction of an image signal to thereby linearly change a brightness value according to a gray level value of the image signal.

The automatic gain controller 42 controls gains of data from the gamma corrector 41 for each red, green and blue color to thereby compensate for a color temperature.

The error diffuser 43 is responsible for diffusing a quantizing error component into adjacent cells to thereby finely adjust a brightness value.

The sub-field mapping unit 44 determines whether a current operation mode is the AV mode or the PC mode in accordance with a signal from the mode selector 53 and selects an optimum sub-field arrangement in the corresponding mode. Further, the sub-field mapping unit 44 maps a data onto the selected sub-field arrangement. For instance, the sub-field mapping unit 44 maps a data onto a sub-field arrangement in which the SE sub-fields are more than the SW sub-field as shown in FIG. 4 in the AV mode, whereas it maps a data onto a sub-field arrangement in which the SW sub-fields are more than the SE sub-fields as shown in FIG. 5 in the PC mode. The data mapped by the sub-field mapping unit 44 is stored in the frame memory 45 and then applied to the data aligner 46.

The data aligner 46 distributes a data from the frame memory 45 in correspondence with the integrated circuits of the data driver 48.

The mode selector 53 senses a mode selection signal inputted via a remote controller, a signal from a AV cable/PC cable connected to a terminal provided at the PDP set or a signal from a mode selection switch provided at the PDP set to thereby select a current operation mode. In other words, if a user selects a mode by the remote controller, or selects a mode by connecting a TV cable or a PC cable to a selection terminal of the PDP or by operating a switch separately provided at the PDP set, then the mode selector 53 senses a mode selected by a user or a cable signal to thereby sense a mode. Further, the mode selector 53 applies a mode data indicating whether a current operation mode is the AV mode or the PC mode to the timing controller 47 and the sub-field mapping unit 44. The timing controller 47 and the sub-field mapping unit 44 controls a sub-field arrangement or the number of sustaining pulses differently in accordance with a current operation mode as mentioned above.

Figure 8:
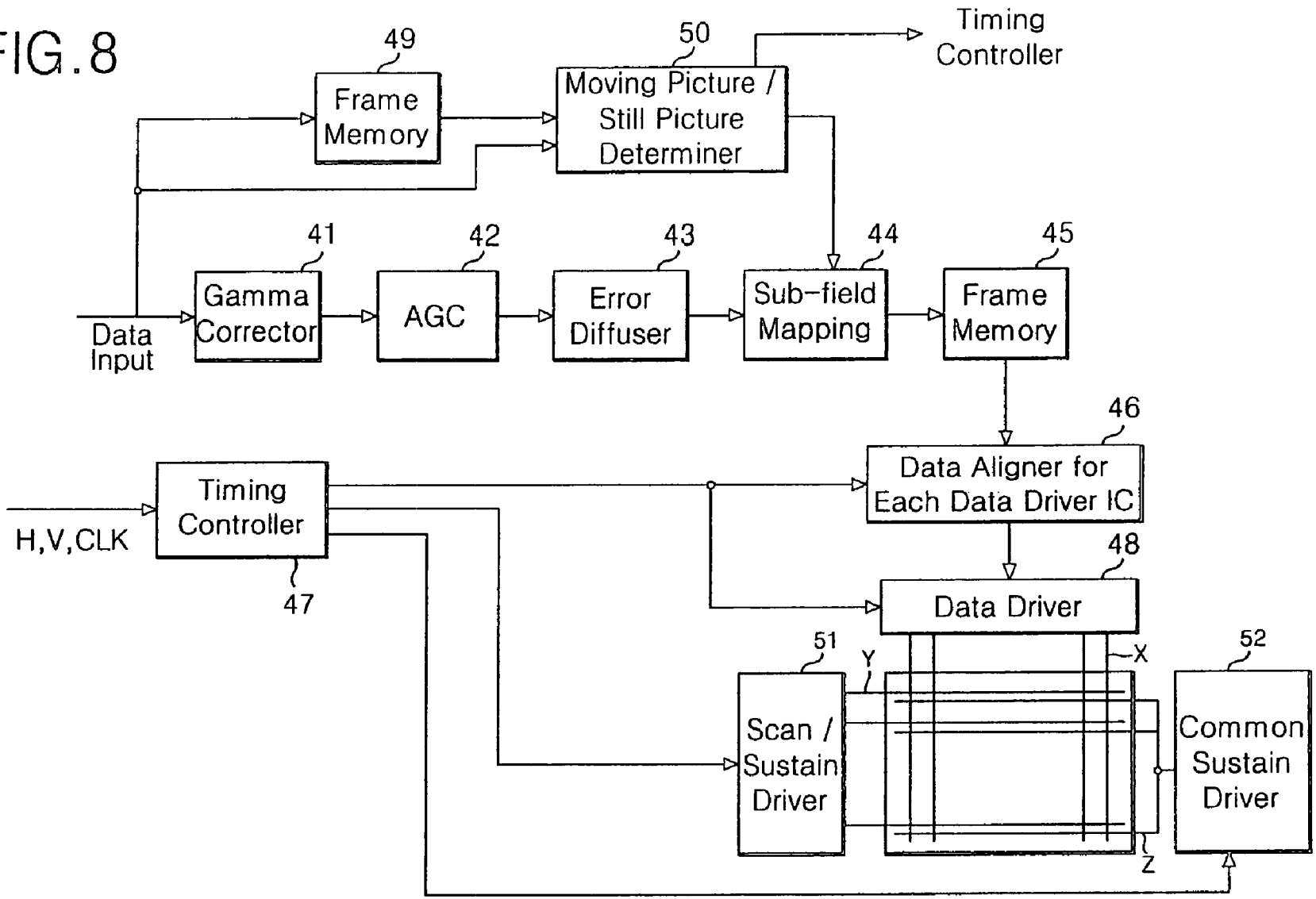
FIG. 8 is a block diagram showing a configuration of a driving apparatus for a plasma display panel according to a second embodiment of the present invention.

FIG. 8 shows a driving apparatus for a plasma display panel according to another embodiment of the present invention. Elements in FIG. 8 identical to the driving apparatus of FIG. 7 will be given the same reference numerals, and a detailed explanation as to these elements will be omitted.

Referring to FIG. 8, the driving apparatus for the plasma display panel includes a frame memory 49 and a moving picture/still picture determiner 50 for determining whether there is a moving picture or a still picture.

The frame memory 49 is responsible for storing a data from an input line of a digital video data during one frame interval to delay the data by one frame interval.

The moving picture/still picture determiner 50 compares a current frame data from the input line with the previous frame data from the frame memory 49 to calculate a variation amount in the data. Further, the moving picture/still picture determiner 50 compares the calculated data variation amount with a predetermined reference value to thereby determine whether or not there is a motion of the picture. As the result of comparison of a data variation amount with a reference value, the moving picture/still picture determiner 50 determines a currently input digital video data to be a moving picture data when the data variation amount is more than the reference value, whereas it determines a currently input digital video data to be a still picture data when the data variation amount is less than the reference value. Further, the moving picture/still picture determiner 50 applies a signal indicating whether a currently input data is a still picture or a moving picture to a sub-field mapping unit 44 and a timing controller 47.

The sub-field mapping unit 44 determines whether or not there is a motion of a currently input image in accordance with the signal from the moving picture/still picture determiner 50 and selects an optimum sub-field arrangement depending upon whether or not there is a motion of the image. Further, the sub-field mapping unit 44 maps the data onto the selected sub-field arrangement for each bit. For instance, the sub-field mapping unit 44 maps the data onto a sub-field arrangement in which the SE sub-fields are arranged to be more than the SW sub-fields as shown in FIG. 4 for a moving picture, whereas it maps the data onto a sub-field arrangement in which the SW sub-fields are arranged to be more than the SE sub-fields as shown in FIG. 5 for a still picture.

The timing controller 47 receives vertical/horizontal synchronizing signals H and V and a clock signal CLK to thereby timing control signals required for the drivers 46, 48, 51 and 52. Further, the timing controller 47 controls the number of sustaining pulses differently in response to a mode selection signal from the moving picture/still picture determiner 50. In other words, the timing controller 47 controls the scan/sustain driver 51 and the common sustain driver 52 by the number of sustaining pulses in a still picture set to be smaller than the number of sustaining pulses in a moving picture. Accordingly, the scan/sustain driver 51 and the common sustain driver 51 generates a different number of sustaining pulses depending upon whether or not there is a motion of the image under control of the timing controller 47.

As described above, according to the present invention, an operation mode of the PDP is determined to be any one of the AV mode and the PC mode with the aid of the remote controller, the cable signal or the mode selection switch, and a data is displayed at a sub-field arrangement having not shown a contour noise in the AV mode while being displayed at a sub-field arrangement having a wide gray level expression range in the PC mode. Also, the number of sustaining pulses in the PC mode is controlled to be less than that in the AC mode. Further, the PDP according to the present invention determines whether or not there is a motion of the image on the basis of a data variation amount and displays a data at an optimum sub-field arrangement according to whether or not there is a motion of the image, to thereby control the number of sustaining pulses. Accordingly, it becomes possible to optimize a sub-field mapping depending upon any one operation mode of the AV mode and the PC mode, or whether or not there is a motion of the image, thereby improving a picture quality when a data from different media like a PC data or a TV data is displayed.

Furthermore, according to the present invention, the number of sustaining pulses can be controlled depending upon any one operation mode of the AV mode and the PC mode, or whether or not there is a motion of the image to thereby reduce the number of sustaining pulses within a range making almost not affect to a picture quality in the PC mode or the still picture and thus reduce power consumption as well as to thereby reduce a deterioration of the phosphorous material being more serious as a discharge frequency goes larger and thus prolong a life of the PDP.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a plasma display panel, comprising:

selecting an operation mode on a basis of a motion extent of a data; and controlling a sub-field arrangement arranged within one frame interval differently in response to said selected operation mode, said frame interval including a plurality of selective erasing sub-fields and a plurality of selective writing sub-fields, wherein said controlling includes:

setting a number of selective erasing sub-fields to be larger than a number of selective writing sub-fields in a first operation mode, and setting a number of selective writing sub-fields to be larger than a number of selective erasing sub-fields in a second operation mode, wherein a total number of sub-fields in the frame interval the first mode of operation equals a total number of sub-fields in the frame interval of the second mode of operation.

2. The method as claimed in claim 1, further comprising: receiving at least one of a signal from a remote controller for remotely controlling the plasma display panel, a cable signal connected to a different media and a signal from a mode selection switch provided separately at the plasma display panel.

3. The method as claimed in claim 2, wherein selecting the operation mode includes: determining said operation mode in response to said received signal.

4. The method as claimed in claim 1, wherein selecting the operation mode includes:

comparing said data between frames to calculate a variation amount, and then comparing said variation amount with a desired reference value, thereby selecting said operation mode.

5. The method as claimed in claim 1, wherein the selective writing sub-fields are for selecting on-cells in an address period and the selective erasing sub-fields are for selecting off-cells in the address period.

6. The method as claimed in claim 1, wherein said controlling includes: if said first operation mode is an AV mode in which a motion extent of said data is large, then setting the number of selective erasing sub-fields to be larger than the number of selective writing sub-fields.

7. The method as claimed in claim 1, wherein said controlling includes: if said second operation mode is PC mode in which a motion extent of said data is small, then setting the number of selective writing sub-fields to be larger than the number of selective erasing sub-fields.

8. The method as claimed in claim 1, wherein differently controlling at least one of said sub-field arrangement and the number of sustaining pulses includes:

if said first operation mode is an AV mode in which a motion extent of said data is large, then setting the number of selective erasing sub-fields to be greater than the number of selective writing sub-fields to reduce contour noise at a moving picture relative to the second operation mode, and if said second operation mode is a PC mode in which a motion extent of said data is small, then setting the number of selective writing sub-fields to be larger than the number of selective erasing sub-fields to increase a gray level expression range relative to the first operation mode.

9. A method of driving a plasma display panel, comprising:

selecting an operation mode on a basis of a motion extent of a data; and controlling a number of sustaining pulses within a frame interval differently in response to said selected operation mode, wherein differently controlling the number of sustaining pulses includes:

if said operation mode is selected to be a PC mode in which a motion extent of said data is small relative to an AV mode, then the number of sustaining pulses within the frame interval is reduced to be smaller than a number of sustaining pulses set in correspondence with the AV mode in which a motion extent of said data is large relative to the PC mode, wherein the reduction in the number of sustaining pulses in PC mode is set to reduce average brightness to within a predetermined range relative to average brightness achieved during AV mode.

10. The method as claimed in claim 9, wherein, in PC mode, the number of sustaining pulses is reduced such that said data is displayed at an average brightness falling in the range of 50% through 80% with respect to an average brightness of said data displayed on the plasma display panel in AV mode in which a motion extent of said data is large.

11. A driving apparatus for a plasma display panel, comprising:

a mode selector for selecting an operation mode on a basis of a motion extent of a data; and a controller for controlling a sub-field arrangement arranged within one frame interval differently in response to said selected operation mode, said frame interval including a plurality of selective erasing sub-fields and a plurality of selective writing sub-fields, said controller:

setting a number of selective erasing sub-fields to be larger than a number of selective writing sub-fields when the mode selector selects a first operation mode, and setting a number of selective writing sub-fields to be larger than a number of selective erasing sub-fields when the mode selector selects a second operation mode, wherein a total number of sub-fields in the frame interval the first mode of operation equals a total number of sub-fields in the frame interval of the second mode of operation.

12. The driving apparatus as claimed in claim 11, wherein said mode selector receives at least one of a signal from a remote controller for remotely controlling the plasma display panel, a cable signal connected to a different media and a signal from a mode selection switch provided separately at the plasma display panel, and determines said operation mode in response to said received signal.

13. The driving apparatus as claimed in claim 11, wherein said mode selector compares said data between frames to calculate a variation amount and then compares said variation amount with a desired reference value, thereby selecting said operation mode.

14. The driving apparatus as claimed in claim 11, wherein the selective writing sub-fields are for selecting on-cells in an address period and the selective erasing sub-fields are for selecting off-cells in the address period within said one frame interval; and if said first operation mode selected by the mode selector is an AV mode in which a motion extent of said data is large, the controller sets the number of selective erasing sub-fields to be larger than the number of selective writing sub-fields.

15. The driving apparatus as claimed in claim 11, wherein the selective writing sub-fields are for selecting on-cells in an address period and the selective erasing sub-fields are for selecting off-cells in the address period within said one frame interval; and if said second operation mode selected by the mode selector is an PC mode in which a motion extent of said data is small, the controller sets the number of selective writing sub-fields to be larger than the number of selective erasing sub-fields.

16. The driving apparatus as claimed in claim 11, wherein:

if said first operation mode selected by the mode selector is an AV mode in which a motion extent of said data is large, then said controller sets the number of selective erasing sub-fields to be greater than the number of selective writing sub-fields to reduce contour noise at a moving picture relative to the second operation mode;

if said second operation mode selected by the mode selector is an PC mode in which a motion extent of said data is small, then said controller sets the number of selective writing sub-fields to be larger than the number of selective erasing sub-fields to increase a gray level expression range relative to the first operation mode.

17. A driving apparatus for a plasma display panel, comprising:

a mode selector to select an operation mode based on motion extent of data; and a controller to control a number of sustaining pulses within a frame interval differently in response to said selected operation mode, wherein if said operation mode selected by the mode selector is an PC mode in which a motion extent of said data is small relative to an AV mode, then said controller controls the number of sustaining pulses to be smaller than a number of sustaining pulses set in correspondence with the AV mode in which a motion extent of said data is large relative to the PC mode, wherein the reduction in the number of sustaining pulses in PC mode is set to reduce average brightness to within a predetermined range relative to average brightness achieved during AV mode.

18. The driving apparatus as claimed in claim 17, wherein, in PC mode, the number of sustaining pulses is reduced such that said data is displayed at an average brightness falling in the range of 50% through 80% with respect to an average brightness of said data displayed on the plasma display panel in AV mode in which a motion extent of said data is large.

19. The method as claimed in claim 1, wherein setting the number of selective erasing sub-fields to be larger than the number of selective writing sub-fields corresponds to a first number of gray levels that are capable of being generated, and wherein setting the number of selective writing sub-fields to be larger than the number of selective erasing sub-fields corresponds to a second number of gray levels that are capable of being generated, the second number of gray levels being greater than the first number of gray levels.

20. The method as claimed in claim 1, wherein the selective writing sub-fields select on cells using binary coding and the selective erasing sub-fields select off cells using linear coding, and wherein a number of gray levels capable of being generated by the selective erasing sub-fields using linear coding is less than a number of gray levels capable of being generated by the selective writing sub-fields.

21. The method as claimed in claim 1, wherein a last one of the selective erasing subfields does not have a reset period and other ones of the selective writing sub-fields have a reset period.

22. The method as claimed in claim 1, wherein a last one of the selective writing sub-fields does not have an erasure period and other ones of the selective writing sub-fields has an erasure period.

* * * * *